United States Patent [19]

Kikis

[11] Patent Number: 4,474,383

[45] Date of Patent: Oct. 2, 1984

[54] BOOK HOLDER

[76] Inventor: Chris T. Kikis, 153-57 Rose Ave., Flushing, N.Y. 11355

[21] Appl. No.: 459,339

[22] Filed: Jan. 20, 1983

[51] Int. Cl.[3] ..... B42D 9/00

[52] U.S. Cl. ..... 281/45; 24/336; 281/42

[58] Field of Search ..... 24/67 R, 336, 341, 344; 281/42, 45

[56] References Cited

U.S. PATENT DOCUMENTS

| | | | |
|---|---|---|---|
| 393,521 | 11/1888 | Roys | 24/336 X |
| 783,906 | 2/1905 | Spielman | 24/336 X |
| 3,701,332 | 10/1972 | Brooks | 281/42 X |
| 3,986,232 | 10/1976 | Teetor | 281/45 X |

*Primary Examiner*—Paul A. Bell

*Attorney, Agent, or Firm*—Charles E. Temko

[57] ABSTRACT

A holder to permit the holding of a hand held book in open condition using a single hand of the reader, thereby facilitating the use of the holder in public transportation vehicles and the like while standing. The device is collapsible when not in use to permit ready storage.

3 Claims, 7 Drawing Figures

BOOK HOLDER

BACKGROUND OF THE INVENTION

This invention relates generally to the field of book holding devices which facilitate the maintenance of a bound book in opened condition at a desired page for reading, so that the book and engaged device may be held by a single hand of a standing reader who uses his other hand to grasp a hanging strap or other support in a moving vehicle. Devices of this general type are known in the art, and the invention lies in novel details of structure which permit improved ease of use and more convenient storage as well as lowered cost of fabrication.

Prior art devices have consisted principally of two types. In a first type, a rigid elongate member such as a ruler of the like is provided with a flexible strap, the ends of which are connected to the ends of the ruler in selective fashion. The opened book is positioned in the interstice therebetween. With this type of device, the book must be disengaged each time it is necessary to turn a page, a major inconvenience. Additionally, when not in use, the use cannot be dismantled for convenient storage. A second type of device is in the form of a one-piece clip, portions of which engage both halves of an open book at a top edge thereof at points adjacent the binding to prevent the book from closing. As each pair of pages is read, the right hand page is slipped from engagement beneath the clip, and slipped beneath the oppositely positioned part of the clip, so that reading may continue. This type of device is somewhat more convenient to use than that first described, but, because engagement of the pages is at or near the centrally disposed binding at the top edge of the book, there is a tendency for the device to become accidentally disengaged, particularly in the case of books of larger dimensions. Further, this type of device has no provision for adjustment to compensate for the thickness of the book, as determined by the total number of ages.

Some devices are fabricated using opaque materials, and when portions of the same overlie portions of the printed text of a page during use, it is necessary to manually shift either the page or the device to permit reading of that portion of a page which is otherwise obscured.

SUMMARY OF THE INVENTION

Briefly stated, the invention contemplates the provision of an improved bookholding device of the class described in which the above mentioned disadvantages have been substantially eliminated. The devices comprises a pair of loop-shaped arm elements having a resiliently expandable clip at the outer ends thereof which engage the interconnected halves of the book along free vertical edges thereof. The elements are preferably of transparent materials so as to permit reading therethrough without shifting the position thereof from engaged position. The elements are pivotally interconnected at inner ends thereof, and one element is slightly smaller than the other both in length and thickness, so as to permit foldable nesting of the elements when not in use to facilitate storage in a purse or pocket. In one embodiment, the elements are mutually adjustable to conform to books of differing sizes.

BRIEF DESCRIPTION OF THE DRAWINGS

In the drawings, to which reference will be made in the specification, similar reference characters have been employed to designate corresponding parts throughout the several views.

DETAILED DESCRIPTION OF THE DISCLOSED EMBODIMENTS

Figure 1:
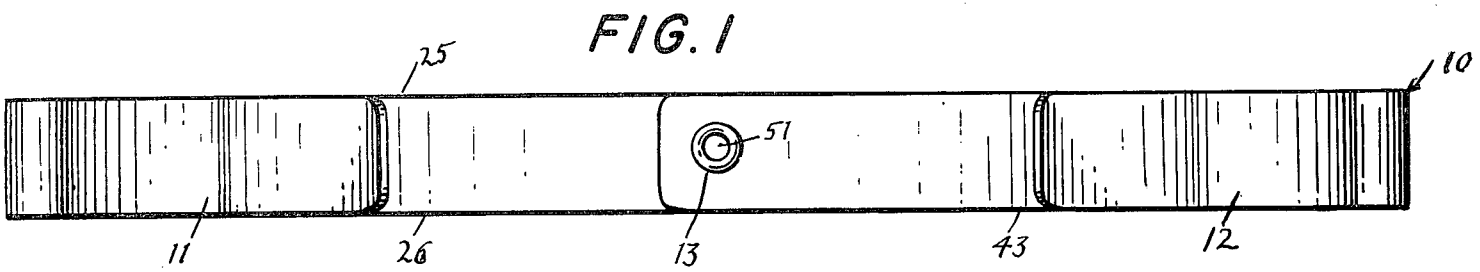
FIG. 1 is a front elevational view of a first embodiment of the invention.

In accordance with the first embodiment of the invention, generally indicated by reference character 10, the device comprises broadly: first and second elongated elements 11 and 12, respectively, and pivotal interconnecting means 13.

The first element 11 is molded from transparent synthetic resinous material, such as acetate, styrene or the like. It is bounded by an inner surface 21, an outer surface 22, an inner end 23, an outer end 24, and parallel side edges 25 and 26. A first portion 27 commences at the inner end 23, and extends over a slightly arcuate path to a bent portion 28, in turn communicating with a laterally extending arcuate portion 29, a second bent portion 30, and a curved terminal portion 31 forming an open ended loop 32.

Figure 2:
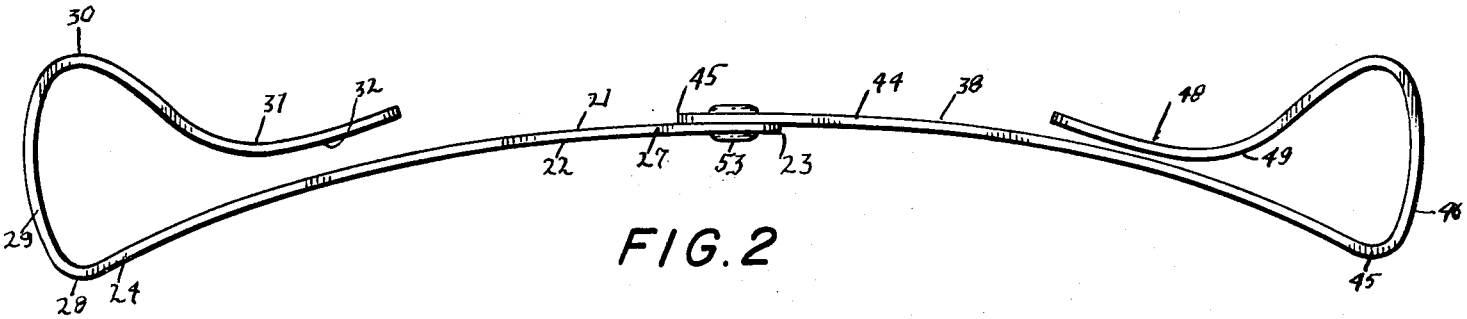
FIG. 2 is a top plan view thereof.
Figure 3:
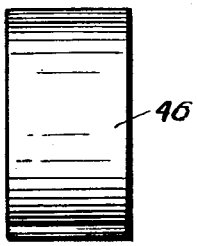
FIG. 3 is an end elevational view thereof.
Figure 4:
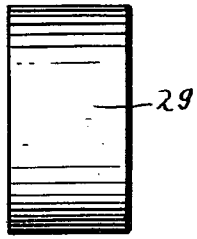
FIG. 4 is an end elevational view thereof showing the end opposite that seen in FIG. 3.

The second element 12 is generally similar in configuration, although slightly shorter in overall length and width of the open ended loop. It is bounded by an inner surface 38, an outer surface 39, and parallel side edges 42 and 43. A first elongate member 44 extends from a first end portion 45 to a first bent portion 45', and communicates with a laterally extending arcuate portion 46, a second bent portion 47 and a curved terminal portion 48 to form an open loop 49, generally opposite that of the loop 32. Referring to FIG. 2, it would be observed that the loop 32, in unstressed condition is slightly more open than the loop 49, in order to avoid difficulty when the device is folded to the condition shown in FIG. 6 for storage.

Figure 6:
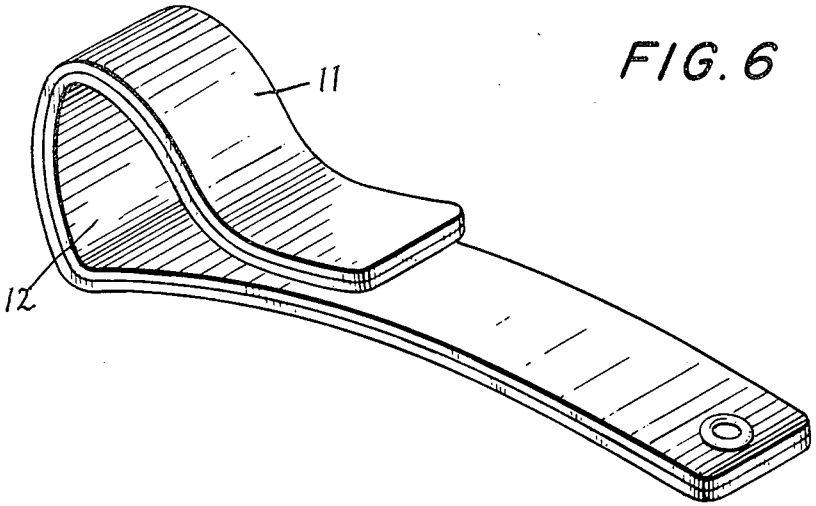
FIG. 6 is a view in perspective showing the embodiment in folded condition.

The pivotal interconnecting means 13 may be of any convenient type, such as a grommet 51 having first and second enlargements 52 and 53 thereon. As shown in FIG. 6, when in folded condition, the overall length of the device is reduced to approximately half of that occupied in extended condition.

Figure 5:
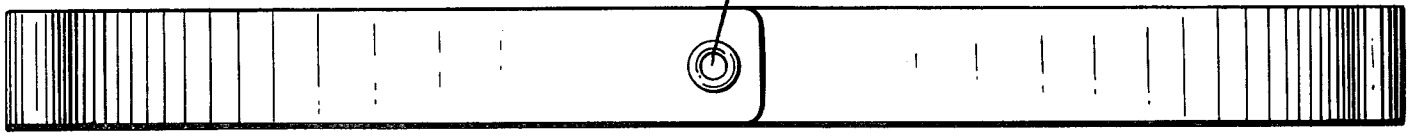
FIG. 5 is a rear elevational view thereof.
Figure 7:
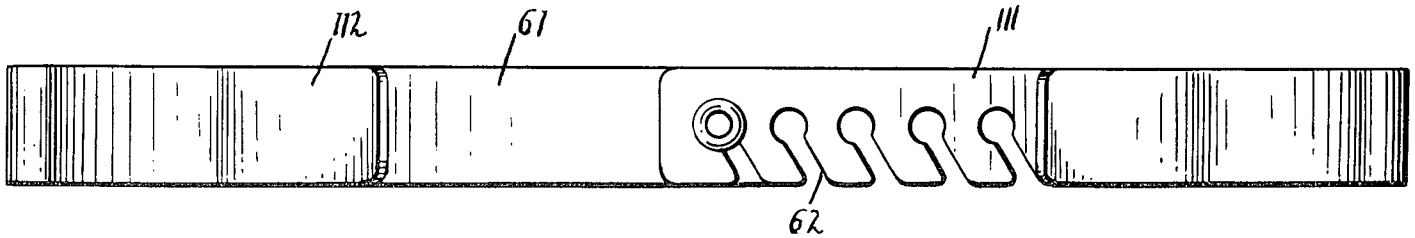
FIG. 7 is a front elevational view of a second embodiment of the invention.

To use the device, it is necessary only to place it in its opened condition as shown in FIGS. 1, 2, and 5, and after opening the book to the desired page, each half of the cover, together with overlying pages (not shown) is inserted beneath the loops 32 and 49 to be resiliently retained thereby. As each page is read, the uppermost page is slipped from beneath one of the loops, and inserted beneath the other. Owing to the transparency of the open ended loops, it is possible to read text directly through the structure without disturbing the same. Turning now to the second embodiment of the invention, illustrated in FIG. 7, and generally indicated by reference character 60, to aVoid needless repetition, certain of the component parts corresponding to those of the first embodiment have been designated by similar reference characters with the additional prefix "1".

In the second embodiment, the second elongate element 61 includes a plurality of parallel slots 62 to permit adjustability of the overall size of the device when in extended condition. If desired, the slots may all communicate with an elongated groove in the body of the second elongate element (not shown), so as to retain captivity of the two elements. Ideally, one of the slots is adapted to relatively position the two elongated elements so that pivotal motion may also occur to bring the second embodiment to nested condition.

It will be observed that in the case of both the first and second embodiment, it is possible to use the device as a bookmark by leaving it engaged in folded condition with the open loop engaged with the book at the page at which reading was temporarily interrupted.

I wish it to be understood that I do not consider the invention limited to the precise details of structure shown and set orth in this specification, for obvious modifications will occur to those skilled in the art to which the invention pertains.

I claim:

1. An improved device for maintaining books in opened condition for reading comprising: first and second elongate elements mutually pivotally interconnected at a single point at one end thereof; each of said elements including an elongated portion commencing at said inner end and extending away from said single point a distance corresponding to approximately the width of a page of an engaged book, and an open ended inwardly facing resilient loop formed integrally with said first portion and forming a means for resiliently clamping a group on pages and underlying portion of the cover of one side of a centrally disposed binding of an engaged book in such manner to permit the uppermost page to be readily moved outwardly from one of said open loops with the completion of reading of said page to be engaged beneath the oppositely disposed loop; said second element being slightly smaller in overall dimensions to permit said second element to be pivotted about said single point relative to said first element to be nested within said second element when not in use.

2. An improved device in accordance with claim 1, further characterized in said first and second elements being formed of transparent synthetic resinous material to permit reading of a page therethrough without the necessity of relative shifting between said open loop and an uppermost page engaged thereby.

3. An improved device in accordance with claim 1, further characterized in the provision of means for adjusting the relative position of said open loops for the accommodation of books of differing page size.

* * * * *